US005134060A

United States Patent [19]

Maekawa et al.

[11] Patent Number: 5,134,060

[45] Date of Patent: Jul. 28, 1992

[54] SILVER HALIDE PHOTOGRAPHIC EMULSION PREPARED WITH SILVER HALIDE GRAINS FORMED IN THE PRESENCE OF A WATER SOLUBLE IRIDIUM COMPOUND AND A NITROGEN-CONTAINING HETEROCYCLIC COMPOUND

[75] Inventors: Hideaki Maekawa; Makoto Kajiwara; Masanobu Miyoshi, all of Odawara; Mitsuhiro Okumura, Hino, all of Japan

[73] Assignee: Konica Corporation, Tokyo, Japan

[21] Appl. No.: 525,445

[22] Filed: May 18, 1990

[30] Foreign Application Priority Data

May 19, 1989 [JP] Japan ..... 1-127570

[51] Int. Cl.[5] ..... G03C 1/005

[52] U.S. Cl. ..... 430/567; 430/569; 430/600; 430/603; 430/611; 430/613

[58] Field of Search ..... 430/567, 569, 600, 603, 430/611, 613

[56] References Cited

U.S. PATENT DOCUMENTS

| | | | |
|---|---|---|---|
| 4,288,535 | 9/1981 | Kanisawa et al. | 430/569 |
| 4,469,783 | 9/1984 | Kuwabara et al. | 430/567 |
| 4,758,504 | 7/1988 | Ohya et al. | 430/569 |
| 4,897,342 | 1/1990 | Kajiwara et al. | 430/569 |
| 4,963,466 | 10/1990 | Kajiwara et al. | 430/567 |
| 5,070,008 | 12/1991 | Maekawa et al. | 430/567 |

FOREIGN PATENT DOCUMENTS

| | | | |
|---|---|---|---|
| 243202 | 10/1987 | European Pat. Off. . | |
| 0256781 | 2/1988 | European Pat. Off. | 430/569 |
| 1-032252 | 2/1989 | Japan | 430/569 |
| 1-216339 | 8/1989 | Japan | 430/569 |

OTHER PUBLICATIONS

Patent Abstracts of Japan, vol. 10, No. 298 (P-505) (2354); Oct. 9, 1986, JPA-61-113056; May 30, 1986.

*Primary Examiner*—Lee C. Wright
*Attorney, Agent, or Firm*—Jordan B. Bierman

[57] ABSTRACT

A silver halide photographic emulsion containing silver halide grains having a silver chloride content of not less than 90 mol % and a method for preparing thereof are disclosed, wherein the silver halide grains are obtained by forming said silver halide grains in the presence of a water-soluble iridium compound and a nitrogen-containing heterocyclic compound capable of forming sparingly-soluble silver salt; and by controlling the addition of said iridium compound, whereby the photographic emulsion is improved in the dependence of gradation on exposure intensity.

17 Claims, No Drawings

SILVER HALIDE PHOTOGRAPHIC EMULSION PREPARED WITH SILVER HALIDE GRAINS FORMED IN THE PRESENCE OF A WATER SOLUBLE IRIDIUM COMPOUND AND A NITROGEN-CONTAINING HETEROCYCLIC COMPOUND

FIELD OF THE INVENTION

The present invention relates to a silver halide light-sensitive photographic emulsion, more particularly to a silver halide light-sensitive photographic emulsion improved in the dependence of gradation on exposure intensity.

BACKGROUND OF THE INVENTION

Recently, in the dye image forming process using a silver halide light-sensitive color photographic material, high temperature development and simplification of processing procedures have been attempted to shorten developing time. To reduce developing time in high temperature color development, it is crucially important to increase developing rate. Developing rate is greatly affected by the following two factors: the type of a silver halide light-sensitive material and the type of a color developer. As to the former factor, the shape and size of silver halide grains, as well as the composition of a silver halide light-sensitive emulsion greatly influence developing rate. As to the latter factor, development rate is affected by the conditions of a color developer, in particular, the type of a development inhibitor. It is known that silver chloride grains are developed at a significantly high rate under specific conditions. In the case of a silver halide light-sensitive color photographic material with silver halide emulsion layers containing silver halide grains each consisting substantially of silver chloride (hereinafter referred to as a silver chloride light-sensitive color photographic material), development rate can be increased considerably as compared with the case of conventional silver chlorobromide light-sensitive materials. Accordingly, the use of silver chloride light-sensitive materials leads to such advantages as a shortened processing time, the employment of small-sized automatic developing machine, a decreased replenishing amount and a less possibility of environmental pollution. Because of these merits, a silver chloride light-sensitive material is expected to be used advantageously for the work in a miniature laboratory that has been attracting a great deal of attention. Various studies were made on the practical use of such silver chloride light-sensitive color photographic material.

It was revealed that, however, in a silver chloride light-sensitive photographic material, sensitivity and gradation were greatly affected by the intensity of exposure, as compared with the case of light-sensitive materials containing silver halide grains with other composition.

Meanwhile, the dependence of sensitivity on exposure intensity at a given amount of exposure is well-known in the art. This phenomenon is not a serious obstacle to successful photographing, since it can be prevented, for instance, by varying the amount of exposure according to anticipated changes in sensitivity.

On the other hand, the dependence of gradation on exposure intensity is a serious problem from a practical viewpoint. Desired gradation is varied according to purpose, and each light-sensitive material is so designed that it will obtain prescribed gradation. When a light-sensitive material is exposed to light, exposure conditions, for instance, the intensity of exposure may vary according to the brightness of objects (in the case of photographing) and the density of an original film (in the case of printing). The use of a light sensitive material which is unable to avoid influence of exposure intensity on gradation leads to the formation of an image with gradation falling outside the prescribed range. In such image, gradation is so hard that details in lower or higher density portions can not be reproduced, or so soft that the image has a dull appearance as a whole.

Light-sensitive photographic printing papers vary in size, generally from E size to full size. Usually, users print some scenes to small-sized printing papers, and then select favorable ones for enlargement. Enlargement is performed by using the same original film as employed in printing to a small-sized printing paper, without a significant increase in the intensity of light source. Therefore, enlargement is inevitably accompanied by a lowering of exposure intensity. When a light-sensitive material which is unable to avoid influence of exposure intensity on gradation is employed for enlargement, gradation is adversely affected by a lowering in exposure intensity, impairing significantly the quality of an image.

As stated above, it is possible to prevent sensitivity from being affected by exposure intensity by using improved exposure equipment. However, as for the influence of exposure intensity on gradation, the use of improved equipment cannot be an effective countermeasure. This problem should be solved by the improvement of a light-sensitive material itself.

The use of iridium compounds was already proposed as a method for making gradation less dependent on exposure intensity. However, studies made by the inventors revealed that, by the conventional technique as to the use of iridium compounds, it was impossible to prevent gradation from being affected by exposure intensity without causing adverse effects on other photographic properties.

The first example of such conventional technique is disclosed in Japanese Patent Publication Open to Public Inspection (hereinafter abbreviated as Japanese Patent O.P.I. Publication) Nos. 147142/1981, 23146/1986, 211142/1983, 97648/1986 and 7042/1987. According to this technique, an iridium compound is added in advance to a mother liquor prior to nucleation or growth of silver halide grains; or is added with a rush to a reactor during the growth of silver halide grains.

However, in this method, a large amount of an iridium compound is needed to make gradation less dependent on exposure intensity, which inevitably causes a significant lowering in sensitivity. Since a silver chloride emulsion inherently has a lower sensitivity, the use of a large amount of an iridium compound significantly impair the quality of a light-sensitive material.

The second example is described in Japanese Patent Examined Publication No. 23248/1982, Japanese Patent O.P.I. Publication Nos. 106424/1976, 205930/1986, 260137/1987, 49752/1988 and 83719/1988. According to this technique, a soluble halide solution containing an iridium compound is added at the time of forming silver halide grains.

However, by the above technique, it is impossible to attain the object of the invention; that is, to obtain a silver halide emulsion containing a silver halide grain having a high silver chloride content, which is improved in sensitivity and the dependence of gradation on exposure intensity, and suited to rapid processing. In the method described in Japanese Patent Examined Publication No. 23248/1982 and Japanese Patent O.P.I, Publication No. 106424/1976, silver halide grains are formed by the single-jet method or the reverse-jet method. Grains obtained by this method have a broader grain size distribution, and hence, gradation is affected greatly by developing temperature and developing time. The method described in Japanese Patent O.P.I. Publication Nos. 205930/1986, 260137/1987, 49752/1988 and 83719/1988 was schemed out for an emulsion having a high silver bromide content. The application of this method to an emulsion having a high silver chloride content leads to a significant lowering in sensitivity.

The inventors carried on studies, and found that, as compared with a silver halide emulsion having a high silver bromide content, a silver halide emulsion having a high silver chloride content requires a smaller amount of an iridium compound than that needed in the case of adding with a rush to a reactor or adding in advance to a mother liquor.

In Japanese Patent O.P.I. Publication Nos. 275256/1987, 275259/1987, 287250/1987, 11941/1987, 40154/1988, 259654/1987, 261349/1987, 304253/1987, 6941/1988, 26837/1988, 26838/1988 and 26840/1988, the addition of a smaller amount of an iridium compound to a silver halide having a high silver chloride content is described. However, the studies by the inventors revealed that an emulsion obtained in this way had a sufficient sensitivity, but was considerably poor in the linearity of gradation. The "linearity" of gradation as referred to herein means that the gradation of a lower density portion of an image is identical with that of a higher density portion. When such linearity is impaired, details in a lower or higher density portion cannot be reproduced at all. In the case of an emulsion obtained by the above method, since the gradation of a lower density portion is soft, while that of a higher density portion is hard, details in the higher density portion (shadow part) cannot be reproduced.

The inventors made extensive studies to obtain a silver halide emulsion having a high silver chloride content, which is improved in sensitivity, the dependence of gradation on exposure intensity, as well as the linearity of gradation. As a result, the inventors have found that the above object can be attained by a silver halide emulsion having a silver chloride content of not less than 90 mol%, which is obtained by forming silver halide grains in the presence of a water-soluble iridium compound and a nitrogen-containing heterocyclic compound forming a sparingly soluble salt with a silver ion; and by controlling the addition of said iridium compound to a reactor where said silver halide grains are formed in such a way that said iridium compound is added in an amount substantially proportional to the total surface area of the grains in the reactor.

The use of a nitrogen-containing heterocyclic compound in forming a silver halide grain is a well-known technique, and described, for example, in Japanese Patent Examined Publication Nos. 23248/1982, 35440/1987, 6942/1989, 38930/1988. However, none of these publications contains a description suggesting that the use of such compound leads to improvement in gradation linearity and other effects as attained by the present invention. It should also be noted that these effects are produced most satisfactorily in a silver halide emulsion having a silver chloride content of not less than 90 mol%. Satisfactory results cannot be obtained when the silver chloride content is smaller than 90 mol%.

SUMMARY OF THE INVENTION

The object of the present invention is to provide a silver halide photographic emulsion containing silver halide grains having a silver chloride content of not less than 90 mol%, which is considerably improved in the dependence of gradation on exposure intensity, as well as in the linearity of gradation from a lower density portion to a higher density portion.

The above object can be attained by a silver halide photographic emulsion containing silver halide grains having a silver chloride content of not less than 90 mol%, which is obtained by forming silver halide grains in the presence of a water-soluble iridium compound and a nitrogen-containing heterocyclic compound capable of forming a sparingly-soluble salt with a silver ion; and by controlling the addition of said water-soluble iridium compound to a reactor where said silver halide grains are formed in such a way that said iridium compound is added in an amount substantially proportional to the total surface area of silver halide grains in the reactor.

DETAILED EXPLANATION OF THE INVENTION

In the silver halide light-sensitive photographic material according to the present invention, silver halide grains contained in at least one silver halide emulsion layer have high silver chloride content of not less than 90 mol%. When the silver chloride content is preferably in the range of 99.0 to 99.9 mol%, not only the effects of the invention are produced satisfactorily, but also it is possible to produce a light-sensitive material which is suited to high-speed processing.

In the present invention, a silver halide grain preferably consists of silver bromochloride, but may also contain silver iodide in such an amount as will not exert any adverse effect on the effects of the invention; namely, not more than 1 mol%, preferably not more than 0.5 mol%. Most preferably, a silver halide grain contains no silver iodide.

It is possible to employ silver halide grains falling outside the scope of the invention together with the silver halide grains of the invention. In this case, in a silver halide emulsion layer containing the inventive silver halide grains, the ratio of the projection area occupied by the inventive silver halide grains to that occupied by all the silver halide grains is preferably not less than 50%, more preferably not less than 75%.

The silver halide grains according to the invention can be prepared by methods disclosed, for example, in Japanese Patent O.P.I. Publication Nos. 45437/1984, 162540/1984, 48754/1984, 222844/1985, 222845/1985, 136735/1985 and 113056/1986. To obtain satisfactory results, it is preferable to employ the controlled double-jet method described in Japanese Patent O.P.I. Publication No. 45437/1984. It is more preferable to employ a photographic emulsion preparation apparatus described in Japanese Patent O.P.I. Publication No. 113056/1986, which performs substantially axial flow stirring by forming a circulating flow passing through a mixer installed in a reactor by sucking up mother liquor in the reactor to said mixer, followed by discharging said mother liquor from the mixer to the reactor. Using said apparatus, silver halide grains are formed by supplying a silver salt solution and/or a halide solution to the mother liquor through a nozzle immersed in the mother liquor.

It is desired that the addition of a soluble silver salt solution and a soluble halide solution be controlled in such a way that these solutions are added in an amount substantially proportional to the total surface area of silver halide grains in a reactor.

Such control allows grains to have a narrower grain size distribution, and eventually prevent photographic properties of an image from being affected by such factors as developer temperature and developing time during rapid processing. In addition, the control makes the gradation of an image less dependent on the intensity of exposure. Studies by the inventors have revealed that the intensity-dependence of gradation correlates to the amount of an iridium compound per grain of a silver halide, rather than the total amount of an iridium compound per total amount of a silver halide.

Therefore, in the case of silver halide grains with a broader grain size distribution, the per-grain amount of an iridium compound varies greatly, causing a difficulty in controlling the intensity-dependence of gradation.

In the present invention, it is preferred that the formation growing of a silver halide grain be performed by the preceding controlled double-jet method. In this case, it is desired that the addition of a soluble halide solution to a reactor be completed later than the completion of the addition of a soluble silver salt solution. By doing this, it is possible to impart an emulsion with an anti-fogging property, and to obtain an image with improved gradation in a lower density portion.

The size of a silver halide grain is not critical. However, in respect of rapid processing suitability, sensitivity and other photographic properties, the grain size is preferably 0.2 to 1.6 μm, more preferably 0.25 to 1.2 μm in diameter.

The grain size can be measured by known methods. The representative method is described in R.P. Labrand: Particle-Size Measurement (A.S.T.M. Symposium of Light Microscopy, 1955, pp. 94–122), or in Mees & James: "Theory of the Photographic Process" (3rd ed., MacMillan Company, 1966, Chapter 2). The grain size can be measured approximately using the diameter of a circle equivalent to the area of projected image of a grain. Accuracy of measurement can be achieved when grains have substantially the same shape.

The grain size distribution may either be monodispersed or polydispersed. In the invention, it is preferable to employ monodispersed silver halide grains in which the grain size distribution has a variation coefficient of not more than 0.22, preferably not more than 0.15. The variation coefficient represents the width of distribution, and is defined by the equation:

Variation coefficient = standard deviation of grain size distribution/average grain size The shape of the silver halide grains is not critical. Preferred is cube having (100) face as a crystal face. Octahedral, tetradecahedral and dodecahedral silver halide grains may also be used, and the method of preparing them are described in U.S. Pat. Nos. 4,183,756, 4,225,666, Japanese Patent O.P.I. Publication No. 26589/1980, Japanese Patent Examined Publication No. 42737/1980 and The Journal of Photographic Science, 21, 39 (1973). Also usable are the silver halide grains having a twinned crystal face, or those having other irregular shapes.

In the present invention, an iridium compound is added at an accelerated rate functionally during the formation of silver halide grains. "Adding at an accelerated rate", means controlling the rate of adding an iridium compound to a reactor, where a silver halide grain is formed in such a way that adding of said iridium compound is accelerated in an amount substantially proportional to the total surface area of silver halide grains in the reactor which increasingly varies during the formation of silver halide grains. Adding an iridium compound in an amount substantially proportional to the total surface area of grains is equivalent to adding an iridium compound in an amount substantially proportional to the rate of adding a soluble silver salt solution when the addition of a soluble silver salt solution is controlled in such a way that the solution is added in an amount substantially proportional to the total surface area of silver halide grains in a reactor. An iridium compound may be added for some period of time during the addition of a soluble silver salt solution. However, if the addition time of an iridium compound is too short, the accelerated addition cannot be performed, leading to an excessive amount of an iridium compound in a reactor.

When use is made of a seed emulsion prepared separately, silver halide grains may be prepared by the method of the invention, and the addition of an iridium compound is not required to be continued throughout the growing of silver halide grains.

Various methods can be used for the addition of an iridium compound. As disclosed in Japanese Patent O.P.I. Publication No. 97648/1986, an iridium compound may be added to a soluble halide solution. Also possible is adding an iridium compound to a soluble silver salt solution or adding it to a reactor through a separate nozzle. Combination of these methods is also employable.

An iridium compound may be added separately to a mother liquor in a reactor, or may be added with a rush during the growing of a silver halide grain. In these cases, to make gradation less dependent on exposure intensity, an iridium compound must be added in an amount several tens times larger than that needed in the accelerated addition of the present invention. However, such large amount addition is unfavorable since it causes a significant lowering in sensitivity.

In the invention, it is possible to employ a mixed solution comprising two or more different kinds of iridium compounds. Alternatively, two or more different kinds of iridium compound solutions may be added separately by different methods.

An iridium compound is added preferably in an amount $10^{-12}$ to $10^{-7}$ mol per mol, more preferably $10^{-10}$ to $10^{-8}$ mol per mol silver halide. The effects of the invention cannot be produced sufficiently when the amount of an iridium compound is less than $10^{-12}$ mol. An amount more than $10^{-7}$ mol is also nonpreferable since it causes such problems as a lowered sensitivity and too soft gradation.

Though the kind of an iridium compound employed in the invention is not critical, iridium (III) halide compounds, iridium (IV) halide compounds and a complex salt of iridium having a halogen, an amine or an oxalate as a ligand are preferable from a viewpoint of stability, safety and economy. The preferred examples of an iridium compound include iridium trichloride, iridium tribromide, potassium hexachloroiridate (III), ammonium iridium (III) sulfate, potassium iridium (III) disulfate, tripotassium iridium (III) trisulfate, iridium (III) sulfate, iridium (III) trioxalate, iridium tetrachloride, iridium tetrabromide, potassium hexachloroiridate (IV), ammonium hexachloroiridate (IV), potassium iridate and iridium (IV) trioxalate.

In the present invention, any of the above compounds may be employed, either singly or in combination.

These iridium compounds are used in the form of a solution obtained by dissolving them in water or a water-miscible solvent. For stabilization, halogen acids (e.g., hydrochloric acid, or hydrobromic acid) or alkali halides (e.g. potassium chloride, sodium chloride, potassium bromide) may be added to the iridium compound-contained solution.

Unnecessary soluble salts may or may not be removed after the growth of a silver halide grain.

To a silver halide emulsion containing silver halide grains according to the invention, at least one kind of a nitrogen-containing heterocyclic compound is added during a period between immediately before the start of forming silver halide grains and the start of chemical sensitization.

There is no restriction as to the kind of a nitrogen-containing heterocyclic compound forming a sparingly soluble salt with a silver ion. However, to produce the effects of the invention more sufficiently, it is preferable to employ a compound containing a mercapto group (hereinafter referred to as a mercapto compound) having a solubility product of the silver salt (Ksp) of not more than $1\times10^{-12}$. The solubility product can be obtained by a method described in "New Course of Experimental Chemistry", Maruzen, Vol. 1 pp. 233 to 250.

The preferable mercapto compounds are those represented by the following Formula [S] and having a Ksp value of not more than $1\times10^{-12}$.

Formula [S]

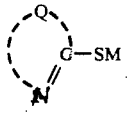

wherein Q represents a group of atoms necessary for forming a 5- or 6-membered heterocycle or a 5- or 6-membered heterocycle condensed with a benzene ring; and M represents a hydrogen atom or a cation.

The examples of the heterocycle include imidazole, triazole, thiadiazole, oxadiazole, tetrazole, thiazole, oxazole, selenazole, triazine, benzoimidazole, naphthoimidazole, benzothiazole, naphthothiazole, benzoselenazole naphthoselenazole and benzoxazole.

Alkali metals (e.g., sodium, potassium), an ammonium group, or the like are employed as the cation represented by M.

The following are the representative examples of the heterocyclic compound forming a sparingly soluble salt with a silver ion.

S-1

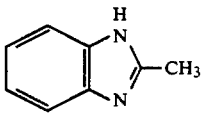

-continued

S-2

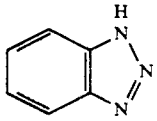

S-3

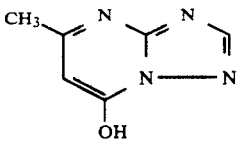

S-4

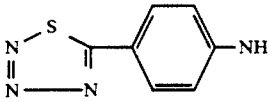

S-5

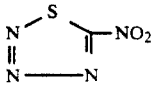

S-6

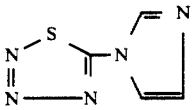

S-7

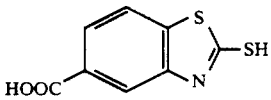

S-8

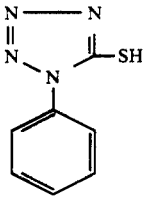

S-9

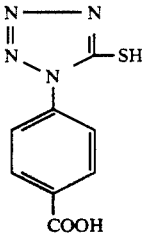

S-10

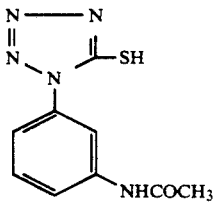

S-11

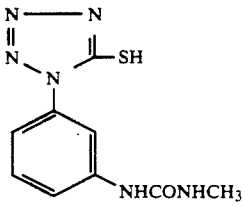

-continued

S-12

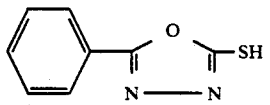

S-13

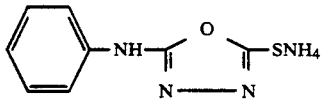

S-14

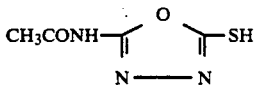

S-15

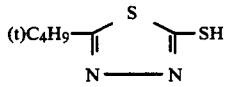

S-16

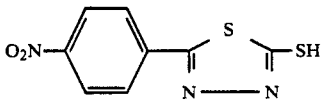

S-17

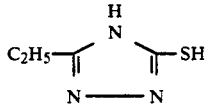

S-18

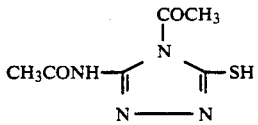

S-19

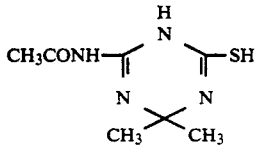

S-20

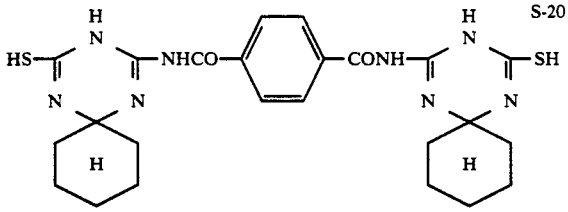

These compounds are described, for example, in Japanese Patent O.P.I. Publication Nos. 36243/1988, 146044/1988 and 196035/1989.

The compound represented by Formula [S] (hereinafter abbreviated as Compound S) is incorporated in a silver halide emulsion layer containing the inventive silver halide grains, after being dissolved in water or a water-miscible organic solvent (e.g., methanol, ethanol). Compound S may be employed either singly or in combination. Combination of Compound S with other agents such as a stabilizer and an anti-fogging agent is also employable.

Compound S may be added at any time during a period between immediately before the start of forming silver halide grains and the start of chemical sensitization. For instance, Compound S may be added to a mother liquor, a soluble silver salt solution or a soluble halide solution prior to the start of forming silver halide grains, or it may be added during grain formation, after grain formation, before desalting, or before redispersion. Compound S may be added either in driplets or all at once. The amount is not critical, but normally $1\times10^{-6}$ to $1\times10^{-1}$ mol, preferably $1\times10^{-5}$ to $1\times10^{-2}$ mol, per mol silver halide.

It is preferred that the silver halide grains of the invention be chemically sensitized in the presence of an unstable sulfur compound and a gold compound. An explanation will be made on these compounds.

In the present invention, the silver halide grain having a silver chloride content of not less than 90 mol% is chemically sensitized using a sulfur sensitizer and a gold sensitizer.

Usable sulfur sensitizers include thiosulfate, arylthiocarbamide, thiourea, arylisothiocyanate, cystine, p-toluenethiosulfonate and rhodanine.

The amount of the sulfur sensitizer is not critical, as long as it is enough to sensitize a silver halide. For instance, the sulfur sensitizer is added in an amount of $1\times10^{-7}$ to $1\times10^{-5}$ mol, preferably $2\times10^{-6}$ to $8\times10^{-6}$ mol, per mol silver halide grain.

Gold compounds having an oxidation number of +1 or +3 are employable as the gold sensitizer. The representative examples include chloroaurate, potassium chloroaurate, auric trichloride, potassium auric thiocyanate, potassium iodoaurate, tetracyano auric acid, ammonium aurothiocyanate and pyridyl trichlorogold.

The amount of the gold sensitizer depends on conditions, but preferably $5\times10^{-7}$ to $5\times10^{-3}$ mol, more preferably $2\times10^{-6}$ to $1\times10^{-4}$ mol, per mol silver halide grain.

The gold sensitizer may be added at any proper time during the preparation of a silver halide emulsion. Preferably, it is added during a period from the completion of forming silver halide grains to the completion of chemical sensitization.

In the present invention, it is preferred that the prescribed Compound S be furthermore added at the time of the completion of chemical sensitization, in an amount of $1\times10^{-6}$ to $1\times10^{-1}$ mol per mol silver halide. Compound S may be added together with, or in the form of a mixture with, such agents as an anti-fogging agent and a stabilizer.

It is a common technique in the art to add a nitrogen-containing heterocyclic compound on or after the completion of an emulsion's chemical ripening. The present invention is distinguished from the conventional technique in adding a nitrogen-containing heterocyclic compound also during the formation of silver halide grains. It should be noted that, by the conventional technique, in which the addition of a heterocyclic compound is made only on or after the completion of chemical sensitization, the effects of the invention cannot be obtained.

The silver halide emulsion according to the invention can be spectrally sensitized to a prescribed wavelength region by using known sensitizing dyes. The sensitizing dyes may be employed either singly or in combination. Together with the sensitizing dyes, dyes which themselves do not have a spectral sensitizing property or supersensitizers which enhance the sensitizing property of sensitizing dyes may be contained in the silver halide emulsion.

Various known sensitizing dyes may be employed, singly or in combination. The preferred examples of the sensitizing dye are given below.

As the sensitizing dye for the blue-sensitive silver halide emulsion, use can be made of dyes described in West German Patent No. 929,080, U.S. Pat. Nos. 2,231,658, 2,493,748, 2,503,776, 2,519,001, 2,912,329, 3,656,959, 3,672,897, 3,694,217, 4,025,349, 4,046,572, British Patent No. 1,242,588, Japanese Patent Examined Publication Nos. 14030/1969 and 24844/1977. The representative examples of the sensitizing dyes for the green-sensitive emulsion include cyanine dyes, merocyanine dyes and composite merocyanine dyes described in U.S. Pat. Nos. 1,939,201, 2,072,908, 2,739,149, 2,945,763 and British Patent No. 505,979. The representative examples of the sensitizing dyes for the red-sensitive emulsion include cyanine dyes, merocyanine dyes and composite merocyanine dyes described in U.S. Pat. Nos. 2,269,234, 2,270,378, 2,442,710, 2,454,629 and 2,776,280. Cyanine dyes, merocyanine dyes and composite merocyanine dyes described in U.S. Pat. Nos. 2,213,995, 2,493,748, 2,519,001 and West German Patent No. 929,080 are advantageous for use in the green-sensitive and red-sensitive emulsions.

These sensitizing dyes may be employed either singly or in combination. Combination of different kinds of sensitizing dye is commonly employed for the purpose of supersensitization. The examples of such combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 4,026,707, British Patent Nos. 1,344,281, 1,507,803, Japanese Patent Examined Publication Nos. 4936/1968, 12375/1978, Japanese Patent O.P.I. Publication Nos. 110618/1967 and 109925/1967.

The amount of the sensitizing dye is not critical, but preferably $1\times10^{-7}$ to $1\times10^{-3}$ mol, more preferably $5\times10^{-6}$ to $5\times10^{-4}$ mol, per mol silver halide.

The sensitizing dyes can be added by conventional methods. That is, they can be added to the silver halide emulsion in the form of a solution obtained by dissolving them in the same solvent. It is also possible to add separately two or more kinds of solutions obtained by dissolving the dyes in separate solvents. A mixture of such solutions is also employable. When two or more kinds of dye solutions are added to the emulsion separately, the order, timing and interval of addition can be determined according to purpose. The sensitizing dye may be added at any proper time during the preparation of the silver halide emulsion, but preferably, during or after the chemical ripening of the emulsion. Most preferably, the addition is made during chemical ripening.

The silver halide emulsion of the invention can be employed for a color negative or positive film and a color photographic printing paper. In particular, the inventive emulsion can be advantageously applied to a color photoprint for direct visual appreciation.

EXAMPLES

The present invention will be described in more detail with reference to the following Examples.

EXAMPLE 1

Using equipment described in Japanese Patent O.P.I. Publication No. 113056/1986, a silver halide emulsion was prepared in the following manner.

| | |
|---|---|
| Liquid a (mother liquor) | |
| Ossein gelatin | 100 g |
| Water | 4000 ml |
| Liquid b (silver salt solution) | 3 N |
| Silver nitrate | 1700 g |
| Water | 2970 ml |
| Liquid c (halide solution) | 2.97 N |
| Sodium chloride | 595 g |
| Potassium bromide | 1.3 g |
| Water | 3090 ml |
| Compound S-10 (0.3% methanol solution) | 90 ml |
| Liquid d (pAg controller) | |
| Sodium chloride | 30 g |
| Water | 500 ml |

While stirring vigorously, Liquids b and c were simultaneously added to Liquid a in the following manner. At that time, to prevent pAg from varying due to a difference in concentration between Liquids b and c, Liquid d was added at each time of adding Liquids b and c.

| Time* (sec) | Liquid b Rate of addition (ml/min) | Liquid c Rate of addition (ml/min) |
|---|---|---|
| 0 | 7.2 | 7.2 |
| 710 | 7.2 | 7.2 |
| 1550 | 11.1 | 11.1 |
| 2410 | 16.0 | 16.0 |
| 3560 | 24.0 | 24.0 |
| 4640 | 33.0 | 33.0 |
| 6170 | 48.0 | 48.0 |
| 7040 | 58.8 | 57.8 |
| 7278 | 57.8 | 57.8 |
| 7279 | 0 | 57.8 |
| 7288 | 0 | 57.8 |
| 7289 | 0 | 0 |

*During the period of 0 to 710 seconds from the start of addition, a silver halide nucleous was formed. During the period of 710 to 7040 seconds from the start, Liquids b and c were added respectively in an amount proportional to the total surface area of silver halide grains.

As a result, a silver bromochloride emulsion having a silver chloride content of 99.9 mol% was obtained. An electron microscopic analysis revealed that the grains were cubic crystals having an average grain size of 0.50 μm. This emulsion was designated as EM-1.

EM-2 to 8 were prepared by adding potassium hexachloroiridate (IV) to the emulsion by various methods. These methods, as well as the average grain size and the variation coefficient of grain size distribution are shown in Table 1.

TABLE 1

| Emulsion No. | Method of adding K2 [IrCl6] | Amount added (mol/mol AgX) | Average grain diameter (μm) | Variation coefficient |
|---|---|---|---|---|
| EM-1 (Comparative) | — | 0 | 0.50 | 0.11 |
| EM-2 (Comparative) | Added to Liquid a | $1.0\times10^{-7}$ | 0.49 | 0.14 |
| EM-3 (Comparative) | Added with a rush to the reactor at | $1.0\times10^{-7}$ | 0.50 | 0.11 |

TABLE 1-continued

| Emulsion No. | Method of adding K2 [IrCl6] | Amount added (mol/mol AgX) | Average grain diameter (μm) | Variation coefficient |
|---|---|---|---|---|
| | 80 minutes after the start of adding Liquids b and c | | | |
| EM-4 (Comparative) | Added with a rush to the reactor at 80 minutes after the start of adding Liquids b and c | $1.0 \times 10^{-9}$ | 0.50 | 0.12 |
| EM-5 (Comparative) | Added to the mother liquor at a fixed rate through a separate nozzle immersed therein | $1.0 \times 10^{-9}$ | 0.50 | 0.10 |
| EM-6 (Invention) | Added to the parent liquid through a separate nozzle immersed therein at a rate proportional to the addition rate of Liquid b | $1.0 \times 10^{-9}$ | 0.50 | 0.10 |
| EM-7 (Invention) | Added to Liquid c | $1.0 \times 10^{-7}$ | 0.51 | 0.12 |
| EM-8 (Invention) | " | $1.0 \times 10^{-9}$ | 0.50 | 0.11 |
| EM-9 (Invention) | " | $1.0 \times 10^{-11}$ | 0.50 | 0.11 |
| EM-10 (Invention) | " | $1.0 \times 10^{-13}$ | 0.50 | 0.12 |

*potassium hexachloroiridate (IV)

EM-1 to 10 were then chemically sensitized using sodium thiosulfate and chloroaurate, followed by spectral sensitization with a green-sensitizing dye GD-1. On completion of chemical ripening, Compound S-10 was added as the stabilizer in an amount of $10^{-2}$ mol per mol silver halide.

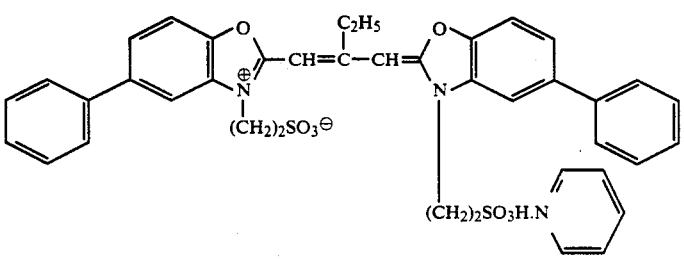

GD-1

Using the above green-sensitive emulsions, silver halide light-sensitive photographic material samples (Sample Nos. 101 to 110) were prepared. Each sample had the following structure and composition:

| | |
|---|---|
| Protective layer | Gelatin |
| | Hardener |
| Emulsion layer | Green-sensitive emulsion |
| | Magenta coupler |
| | High boiling point organic solvent |
| | Gelatin |
| Support | Polyethylene-coated paper |

After ordinary imagewise exposure and the following photographic processing, the samples were subjected to sensitometry.

Sensitivity is defined as the reciprocal of the amount of light required to obtain a reflection density of 0.8, and indicated as a relative value.

The dependence of image gradation on the intensity of exposure was evaluated by examining the difference of gradation ($\Delta\overline{\gamma}$) caused by changing the wedge exposure time from 0.05 seconds (higher intensity) to 10 seconds (lower intensity), keeping the amount of exposure unchanged. The gradation ($\gamma$) was defined as a gradient between reflection densities of 0.8 and 1.2.

The results are shown in Table 2.

| [Processing procedures] | Temperature (°C.) | Time (sec) |
|---|---|---|
| Color development | 35.0 ± 0.3 | 45 |
| Bleach-fixing | 35.0 ± 0.5 | 45 |
| Stabilization | 30 to 34 | 90 |
| Drying | 60 to 80 | 60 |

| Color developer | |
|---|---|
| Water | 800 ml |
| Triethanol amine | 10 g |
| N,N-diethylhydroxylamine | 5 g |
| Potassium bromide | 0.02 g |
| Potassium chloride | 2 g |
| Potassium sulfite | 0.3 g |
| 1-hydroxyethylidene-1,1-diphosphonic acid | 1.0 g |
| Ethylenediaminetetraacetic acid | 1.0 g |
| Disodium catechol-3,5-disulfonate | 1.0 g |
| N-ethyl-N-β-methanesulfoamidoethyl-3-methyl-4-aminoaniline sulfate | 4.5 g |
| Optical brightening agent (a 4,4'- | 1.0 g |

-continued

| | |
|---|---|
| diaminostilbene disulfonic acid derivative) | |
| Potassium carbonate | 27 g |

Water was added to make total quantity 1 liter and pH was adjusted to 10.10.

| Bleach-fixer | |
|---|---|
| Ferric ammonium ethylenediaminetetraacetate dihydrate | 60 g |
| Ethylenediaminetetraacetic acid | 3 g |
| Ammonium thiosulfate (an aqueous 70% solution) | 100 ml |
| Ammonium sulfite (an aqueous 40% solution) | 27.5 ml |

Water was added to make total quantity 1 liter and pH was adjusted to 6.2 with potassium carbonate or glacial acetic acid.

| Stabilizer | |
|---|---|
| 5-chloro-2-methyl-4-isothiazoline-3-one | 1.0 g |
| Ethylene glycol | 1.0 g |
| 1-hydroxyethylidene-1,1-diphosphonic acid | 2.0 g |
| Ethylenediaminetetraacetic acid | 1.0 g |
| Ammonium hydroxide (an aqueous 20% solution) | 3.0 g |
| Ammonium sulfite | 3.0 g |
| Optical brightening agent (a 4,4'-diaminostilbene disulfonic acid derivative) | 1.5 g |

Water was added to make total quantity 1 liter and pH value was adjusted to 7.0 with sulfuric acid or potassium hydroxide.

TABLE 2

| Sample No. | Emulsion No. | Sensitivity | Δγ |
|---|---|---|---|
| 101 | EM-1 (Comparative) | 100 | 0.54 |
| 102 | EM-2 (Comparative) | 58 | 0.37 |
| 103 | EM-3 (Comparative) | 64 | 0.28 |
| 104 | EM-4 (Comparative) | 93 | 0.48 |
| 105 | EM-3 (Comparative) | 99 | 0.39 |
| 106 | EM-6 (Invention) | 101 | 0.27 |
| 107 | EM-7 (Invention) | 98 | 0.23 |
| 108 | EM-8 (Invention) | 101 | 0.18 |
| 109 | EM-9 (Invention) | 102 | 0.24 |
| 110 | EM-10 (Invention) | 100 | 0.30 |

As is evident from the results shown in Table 2, Samples EM-6 to 10 of the invention were improved in sensitivity and the dependence of gradation on exposure intensity.

In the cases where the iridium compound was added in advance to the mother liquor or added with a rush to the reactor, the light-sensitive materials had a lower sensitivity. Decreasing the amount of the iridium compound for preventing sensitivity from lowering inevitably made gradation greatly dependent on exposure intensity. When the iridium compound was added at a constant rate through a separate nozzle, though better results were obtained as compared with the above cases, the dependence of gradation on exposure intensity could not be improved to a sufficient level.

From these results, it is obvious that only the emulsions of the invention were improved in sensitivity and dependence of gradation on the intensity of exposure.

EXAMPLE 2

Using the same reactor, Liquid a, Liquid b and Liquid c (potassium hexachloroiridate (IV) content: $1.0\times10^{-9}$ mol/mol AgX) as employed in the preparation of the emulsion EM-8 in Example 1, silver halide emulsions were prepared by the addition methods shown in Table 3.

TABLE 3

| Emulsion No. | Preparation method of silver halide |
|---|---|
| EM-11 | Liquid b and Liquid c were added to Liquid a. The rate of addition was same as in Example 1. pAg was controlled at 7.5 with Liquid d. |
| EM-12 | Liquid b and Liquid c were added to Liquid a. The rate of addition was fixed at 17 ml/min. pAg was controlled at 7.5 with Liquid d. |
| EM-13 | Liquid a and Liquid b were mixed. Liquid c was then supplied onto the surface of the mixture at a rate of 17 ml/min. |
| EM-14 | Liquid a and Liquid c were mixed. Liquid b was then supplied to the mixture at rate of 17 ml/min. |
| EM-15 | Liquid a and Liquid c were mixed. Liquid b was then supplied to the mixture with a rush. |

Using the above emulsions, silver halide light-sensitive materials were prepared and then examined for the dependence of image gradation on exposure intensity in the same manner as in Example 1. The results are shown in Table 4.

TABLE 4

| Sample No. | Emulsion No. | Δγ |
|---|---|---|
| 108 | EM-8 (Invention) | 0.18 |
| 201 | EM-8 (Invention) | 0.21 |
| 202 | EM-12 (Comparative) | 0.58 |
| 203 | EM-13 (Comparative) | 0.70 |
| 204 | EM-14 (Comparative) | 0.29 |
| 205 | EM-15 (Comparative) | 0.46 |

From the above results, it is evident that, in the samples of the invention obtained by adding an iridium compound in an amount proportional to the total surface area of silver halide grains in the reactor by controlling the rate of adding the compound, the gradation of an image was hardly affected by the intensity of exposure.

EXAMPLE 3

Using the same reactor, Liquid a, Liquid b and Liquid c (potassium hexachloroiridate (IV) content: $1.0\times10^{-9}$ mol/mol AgX) as employed in the preparation of the emulsion EM-8 in Example 1, silver halide emulsions were prepared in the following manner of addition.

| | EM-16 | |
|---|---|---|
| Time (sec) | Rate of adding Liquid b (ml/min) | Rate of adding Liquid c (ml/min) |
| 0 | 7.2 | 7.2 |
| 710 | 7.2 | 7.2 |
| 1550 | 12.9 | 12.9 |
| 2410 | 18.8 | 18.8 |
| 3560 | 26.6 | 26.6 |
| 4640 | 34.0 | 34.0 |
| 6170 | 44.4 | 44.4 |
| 7040 | 50.4 | 50.4 |
| 7278 | 52.0 | 52.0 |
| 7279 | 0 | 0 |

| Time (sec) | EM-17 Rate of adding Liquid b (ml/min) | Rate of adding Liquid c (ml/min) |
|---|---|---|
| 0 | 7.2 | 7.2 |
| 710 | 7.2 | 7.2 |
| 748 | 26.4 | 26.4 |
| 7278 | 26.4 | 26.4 |
| 7279 | 0 | 0 |

EM-18

The silver halide emulsion was prepared in the same manner of addition as in EM-1, except that the addition rate of Liquid c was zero at a point 7279 seconds from the start.

Using the above emulsions, light-sensitive materials were prepared in the same manner as in Example 1, and examined for fog and the dependence of gradation on exposure intensity. The results are shown in Table 5.

TABLE 5

| Sample No. | Emulsion No. | Fog | Δγ | Variation coefficient |
|---|---|---|---|---|
| 108 | EM-8 (Invention) | 0.04 | 0.18 | 0.11 |
| 301 | EM-16 (Comparative) | 0.05 | 0.45 | 0.26 |
| 302 | EM-17 (Comparative) | 0.05 | 0.53 | 0.35 |
| 303 | EM-18 (Invention) | 0.06 | 0.19 | 0.11 |

From the above results, it is evident that EM-8 and 18 of the invention were improved in the dependence of gradation on the intensity of exposure. On the other hand, EM-16 and 17, which were prepared at an addition rate being not proportional to the total surface area of silver halide grains, had a larger value of Δγ.

EM-8, which was prepared by completing addition of a soluble halide solution later than the completion of adding a soluble silver salt solution, was more improved in fog than EM-18 which was prepared by completing addition of a soluble halide solution simultaneously with the completion of adding a soluble silver salt solution.

EXAMPLE 4

Silver halide emulsions were prepared in substantially the same manner as in the emulsion EM-8 of Example 1, except that conditions were varied to those shown in Table 6.

TABLE 6

| Emulsion No. | Silver chloride content (mol %) | Nitrogen-containing heterocyclic compound (the manner of addition) | Grain size in diameter (μm) | Variation coefficient |
|---|---|---|---|---|
| EM-19 (Invention) | 100 | S-10 $1.2 \times 10^{-4}$ mol/mol AgX (added to Liquid c) | 0.50 | 0.11 |
| EM-20 (Invention) | 95 | S-10 $1.2 \times 10^{-4}$ mol/mol AgX (added to Liquid c) | 0.50 | 0.12 |
| EM-21 (Comparative) | 85 | S-10 $1.2 \times 10^{-4}$ mol/mol AgX (added to Liquid c) | 0.50 | 0.11 |
| EM-22 (Invention) | 99.9 | S-10 $1.2 \times 10^{-4}$ mol/mol AgX (added to Liquid c) | 0.50 | 0.35 |
| EM-23 (Invention) | 99.9 | S-3 $1.2 \times 10^{-4}$ mol/mol AgX (added to Liquid c) | 0.50 | 0.10 |
| EM-24 (Invention) | 99.9 | S-3 $1.2 \times 10^{-4}$ mol/mol AgX (added to Liquid c) | 0.50 | 0.11 |
| EM-25 (Invention) | 99.9 | S-10 $1.2 \times 10^{-4}$ mol/mol AgX (added to the reactor with a rush after the addition of Liquid c) | 0.50 | 0.10 |
| EM-26 (Comparative) | 99.9 | — | 0.50 | 0.11 |
| EM-27 (Invention) | 99.9 | S-10 $1.2 \times 10^{-4}$ mol/mol AgX (added to Liquid c) | 0.75 | 0.09 |
| EM-28 (Invention) | 99.9 | S-10 $1.2 \times 10^{-4}$ mol/mol AgX (added to Liquid c) | 0.35 | 0.15 |
| EM-29 (Invention) | 99.9 | S-10 $1.2 \times 10^{-4}$ mol/mol AgX (added to Liquid c) | 1.8 | 0.08 |

Using the above emulsions, light-sensitive materials were prepared in the same manner as in Example 1, and examined for the dependence of gradation on the intensity of exposure, and gradations in a lower density portion ($\gamma_L$) and a higher density portion ($\gamma_H$) of the image obtained by exposure of 0.5 seconds. The $\gamma_L$ was expressed in terms of a gradient between reflection densities of 0.2 and 0.8 and the $\gamma_H$ was expressed in terms of a gradient between reflection densities of 0.8 to 1.2. The results are shown in Table 7.

TABLE 7

| Sample No. | Emulsion No. EM-1 | Δγ | γL | γH | Linearity of gradation |
|---|---|---|---|---|---|
| 101 | EM-1 (Comparative) | 0.54 | 1.9 | 3.2 | A |
| 104 | EM-2 (Comparative) | 0.48 | 1.7 | 3.0 | B |
| 108 | EM-8 (Invention) | 0.18 | 2.4 | 3.6 | A |
| 401 | EM-19 (Invention) | 0.28 | 1.9 | 3.4 | A |
| 402 | EM-20 (Invention) | 0.26 | 2.3 | 3.6 | A |
| 403 | EM-21 (Comparative) | 0.39 | 1.7 | 3.3 | C |
| 404 | EM-22 (Invention) | 0.27 | 1.8 | 3.2 | A |
| 405 | EM-23 (Invention) | 0.25 | 2.1 | 3.5 | A |
| 406 | EM-24 (Invention) | 0.26 | 1.9 | 3.2 | A |

TABLE 7-continued

| Sample No. | Emulsion No. EM-1 | Δγ | γL | γH | Linearity of gradation |
|---|---|---|---|---|---|
| 407 | EM-25 (Invention) | 0.20 | 2.4 | 3.5 | A |
| 408 | EM-26 (Comparative) | 0.31 | 1.7 | 4.9 | C |
| 409 | EM-27 (Invention) | 0.22 | 1.8 | 3.1 | A |
| 410 | EM-28 (Invention) | 0.16 | 2.8 | 4.1 | A |
| 411 | EM-29 (Invention) | 0.29 | 1.7 | 2.9 | A |

The linearity of gradation was evaluated on photoprints prepared from these light sensitive materials. The evaluation was made based on the following criterion:

A: Very good and practically employable

B: Good

C: Poor reproducibility in lower and higher density portions

From the results shown in Table 7, it is evident that EM-8, 19, 20, 22, 23, 24, 25, 27, 28 and 29 were improved in the dependence of gradation on exposure intensity as well as the linearity of gradation.

Of these emulsions, especially excellent were EM-8, 25, 27 and 28, in each of which the silver halide had a silver chloride content of 99.0 to 99.9 mol%, a variation coefficient of not more than 0.22 and a grain size of 0.25 to 1.2 μm, and a mercapto compound was employed as the nitrogen-containing heterocyclic compound. EM-21 with a silver chloride content of not more than 90 mol% and EM-26 prepared by a method in which grains were formed in the absence of a nitrogen-containing heterocyclic compound were poor in the linearity of gradation and the dependence of gradation on exposure intensity.

EXAMPLE 5

Silver halide light-sensitive materials were prepared in substantially the same manner as in EM-8 of Example 1, except that the nitrogen-containing heterocyclic compound was varied to S-1, S-4, S-8, S-9, S-11, S-13, S-15, S-18 and S-19. The same evaluation as in Example 1 revealed that the effects of the invention were obtained in each of these samples.

EXAMPLE 6

The effects of the invention were obtained in light-sensitive materials prepared in substantially the same manner as in Example 1, except that the iridium compound was varied to iridium trichloride, potassium hexachloroiridate (III), tripotassium iridium (III) trisulfate, and iridium (IV) trioxalate.

What is claimed is:

1. A silver halide photographic emulsion containing silver halide grains having a silver chloride content of not less than 90 mol%, which is obtained by forming said silver halide grains in the presence of a water-soluble iridium compound and a nitrogen-containing heterocyclic compound capable of forming a sparingly-soluble salt with a silver ion; and by controlling the addition of said water-soluble iridium compound to a reactor where said silver halide grains are formed in such a way that said iridium compound is added in an amount substantially proportional to the total surface area of silver halide grains in the reactor.

2. A silver halide photographic emulsion according to claim 1, wherein the formation of said silver halide grains is performed by the controlled double-jet method.

3. A silver halide photographic emulsion according to claim 2, wherein the formation of silver halide grains is performed by adding a silver salt solution and/or a halide solution to mother liquor in a reactor through a nozzle immersed in the mother liquor while using a photographic emulsion preparation apparatus which performs substantially axial flow stirring by forming a circulating flow passing through a mixer installed in the reactor by sucking up the mother liquor to the mixer, followed by discharging the mother liquor from the mixer to the reactor.

4. A silver halide photographic emulsion according to claim 3, wherein the rate of adding said silver salt solution and/or said halide solution is controlled in such a way that they are added in an amount substantially proportional to the total surface area of silver halide grains in the reactor.

5. A silver halide photographic emulsion according to claim 4, wherein the addition of said halide solution is completed later than the completion of adding said silver salt solution.

6. The emulsion of claim 1 wherein said nitrogen-containing heterocyclic compound is represented by Formula S, which is capable of forming a silver salt having a solubility product of not more than $10^{-12}$

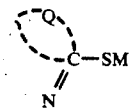

Formula S wherein Q represents a group of atoms necessary for forming a 5- or 6-membered heterocycle or a 5- or 6-membered heterocycle condensed with a benzene ring; and M represents a hydrogen atom or a cation.

7. A silver halide photographic emulsion according to claim 1, wherein said water-soluble iridium compound is added in an amount of $10^{-12}$ to $10^{-7}$ mol per mol silver halide.

8. A silver halide photographic emulsion according to claim 1, wherein said silver halide grain has a silver chloride content of 99.0 to 99.9 mol%.

9. A silver halide photographic emulsion according to claim 1, wherein said silver halide photographic emulsion contains monodisperse silver halide grains having a variation coefficient of not more than 0.22.

10. A method of preparing a silver halide photographic emulsion containing silver halide grains having a silver chloride content of not less than 90 mol%, which is obtained by forming said silver halide grains in the presence of a water-soluble iridium compound and a nitrogen-containing heterocyclic compound capable of forming sparingly-soluble salt with a silver ion; and by controlling the addition of said water-soluble iridium compound to a reactor where said silver halide grains are formed in such a way that said iridium compound is added in an amount substantially proportional to the total surface area of silver halide grains in the reactor.

11. A method of preparing a silver halide photographic emulsion according to claim 10, wherein the formation of said silver halide grains is performed by the controlled double-jet method.

12. A method of preparing a silver halide photographic emulsion according to claim 11, wherein the formation of silver halide grains is performed by adding a silver salt solution and/or a halide solution to mother liquor in a reactor through a nozzle immersed in the mother liquor, while a photographic emulsion preparation apparatus which performs substantially axial flow stirring by forming a circulating flow passing through a mixer installed in the reactor by sucking up the mother liquor to the mixer, followed by discharging the mother liquor from the mixer to the reactor.

13. A method of preparing a silver halide photographic emulsion according to claim 12, wherein the rate of adding said silver salt solution and/or said halide solution is controlled in such a way that they are added in an amount substantially proportional to the total surface area of silver halide grains in the reactor.

14. A method of preparing a silver halide photographic emulsion according to claim 13, wherein the addition of said halide solution is completed later than the completion of adding said silver salt solution.

15. The method of claim 10 wherein said nitrogen-containing heterocyclic compound is represented by Formula S, which is capable of forming a silver salt having a solubility product of not more than $10^{-12}$ Formula S

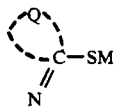

where Q represents a group of atoms necessary for forming a 5- or 6-membered heterocycle or a 5- or 6-membered heterocycle condensed with a benzene ring; and M represents a hydrogen atom or a cation.

16. A method of preparing a silver halide photographic emulsion according to claim 10, wherein said silver halide photographic emulsion contains monodispersed silver halide grains having a variation coefficient of not more than 0.22.

17. A method of preparing a silver halide photographic emulsion according to claim 10, wherein said silver halide grains has a silver chloride content of 99.0 to 99.9 mol%.

* * * * *